US009982486B2

(12) United States Patent
Lennartsson et al.

(10) Patent No.: US 9,982,486 B2
(45) Date of Patent: May 29, 2018

(54) ARRANGEMENT AND DOWN-THE-HOLE DRILLING EQUIPMENT FOR ANGULAR SETTING OF A DRILL STRING

(71) Applicant: LKAB Wassara AB, Huddinge (SE)

(72) Inventors: Erik Lennartsson, Stockholm (SE); Markus Lundborg, Solna (SE)

(73) Assignee: LKAB Wassara AB, Huddlinge (SE)

( * ) Notice: Subject to any disclaimer, the term of this patent is extended or adjusted under 35 U.S.C. 154(b) by 189 days.

(21) Appl. No.: 14/897,977

(22) PCT Filed: Jun. 3, 2014

(86) PCT No.: PCT/SE2014/050672

§ 371 (c)(1),
(2) Date: Dec. 11, 2015

(87) PCT Pub. No.: WO2014/200416

PCT Pub. Date: Dec. 18, 2014

(65) Prior Publication Data

US 2016/0145942 A1 May 26, 2016

(30) Foreign Application Priority Data

Jun. 14, 2013 (SE) ..... 1350729

(51) Int. Cl.
*E21B 7/06* (2006.01)
*E21B 17/20* (2006.01)

(52) U.S. Cl.
CPC ..... *E21B 7/067* (2013.01); *E21B 17/20* (2013.01)

(58) Field of Classification Search
None
See application file for complete search history.

(56) References Cited

U.S. PATENT DOCUMENTS

| | | | | |
|---|---|---|---|---|
| 2,242,279 | A | 5/1941 | Young | |
| 8,590,636 | B2 * | 11/2013 | Menger | E21B 17/1014 175/61 |
| 9,057,223 | B2 * | 6/2015 | Perrin | E21B 7/06 |
| 2003/0127252 | A1 * | 7/2003 | Downton | E21B 7/067 175/73 |
| 2011/0042144 | A1 * | 2/2011 | Downton | E21B 7/067 175/73 |

FOREIGN PATENT DOCUMENTS

| | | | |
|---|---|---|---|
| WO | 96/30616 | A1 | 10/1996 |
| WO | 2009/085753 | A2 | 7/2009 |
| WO | 2012/023043 | A2 | 2/2012 |

OTHER PUBLICATIONS

International Search Report received for PCT Application No. PCT/SE2014050672, dated Oct. 14, 2014, 4 pages.

(Continued)

*Primary Examiner* — Shane Bomar
(74) *Attorney, Agent, or Firm* — Morrison & Foerster LLP

(57) ABSTRACT

An arrangement for the angular setting of a drill string includes a first tubular member, a second tubular member, a plurality of control and actuator devices that can be shortened and lengthened in a longitudinal direction through the influence of a driving device, and remote controllers by which the control and actuator devices can be set selectively and independently of each other in a radially extended or radially withdrawn condition.

9 Claims, 3 Drawing Sheets

(56) References Cited

OTHER PUBLICATIONS

International Preliminary Report on Patentability received for PCT Patent Application No. PCT/SE2014/050672, dated Dec. 23, 2015, 7 pages.
Written Opinion received for PCT Patent Application No. PCT/SE2014/050672, dated Oct. 14, 2014, 5 pages.

* cited by examiner

ARRANGEMENT AND DOWN-THE-HOLE DRILLING EQUIPMENT FOR ANGULAR SETTING OF A DRILL STRING

CROSS REFERENCE TO RELATED APPLICATIONS

This application is a U.S. National Stage patent application of PCT/SE2014/050672, filed on Jun. 3, 2014, which claims priority to Swedish Patent Application No. 1350729-8, filed on Jun. 14, 2013, the entire contents of which are incorporated herein by reference.

FIELD OF THE INVENTION

The present invention concerns an arrangement to guide the direction of a drill string in a borehole during drilling with down-the-hole drilling equipment. The invention concerns also down-the-hole drilling equipment.

BACKGROUND OF THE INVENTION

The mining of rock and ore in mines, both above ground and below ground, takes place principally through drilling and blasting. It has become clear that the cost of mining can be considerably reduced if the technique of drilling long holes with high precision is mastered. In particular, improved possibilities to guide a drill string, and thus also a drill tool or drill bit that is situated at the front of the drill string, during drilling are aspired to, i.e., to achieve what is known as "directionally controlled drilling". It is possible in this way to cause the drill bit to work forwards through the rock along a pre-determined pathway that may extend linearly, or may be shaped as an arc with a certain curvature. Improved possibilities for setting and guiding the direction of the drill bit during drilling can make the drilling more efficient, by making it possible to drill exclusively where it is necessary, to achieve, for example, higher efficiency through concentrating the drilling solely to those parts of the rock that contain ore. It would be desirable also to make it possible in a simple manner to set and drill, with a down-the-hole drill, based on a reference coordinate system in three-dimensions that has been established in advance, and in this way cause a drill bit not only to move along a pre-determined pathway but also to guide the drill bit such that it can reach with high precision a pre-determined goal in a three-dimensional space.

The production of a curvature or oblique placement between the drill bit and a rear part of a drill string in order to make directional guidance of a drill bit possible is previously known. In order to achieve this oblique placement, the use of various types of joint arrangement in the down-the-hole drilling equipment that can be reset into various angular conditions with the aid of control and actuator means is previously known. Energy to achieve this setting can be obtained in various ways, for example pressurised air that is supplied through a hollow drill string, or through the use of the force that arises when the drill rod rotates relative to the cavity wall. In the case of drilling with the aid of down-the-hole drilling equipment that is supplied with a working fluid through a passage that extends through the drill string, it has proved to be appropriate to use a partial flow of the said working fluid as a source of energy for the directional guidance of the drill bit.

SUMMARY OF THE INVENTION

The purpose of the present invention is to achieve an arrangement that makes it possible to directionally guide in a simple and efficient manner a drill string in a borehole during drilling with down-the-hole drilling equipment and in this way to cause a drill bit to move along a pre-determined pathway. In particular, the achievement of an arrangement that is robust and reliable is aspired to, and an arrangement that makes it possible through its design to guide with high precision a drill bit in different directions relative to the drill string. One purpose of the invention is also to achieve down-the-hole drilling equipment intended to be a component of the arrangement.

This purpose of the invention is achieved through an arrangement that demonstrates the distinctive features and characteristics that are specified below, and down-the-hole drilling equipment of the type that is specified below. Further advantages of the invention are made clear below.

BRIEF DESCRIPTION OF THE DRAWINGS

The invention is described in more detail below with the guidance of a non-limiting embodiment that is shown in the attached drawings, in which.

DETAILED DESCRIPTION OF THE INVENTION

Figures 1, 2:
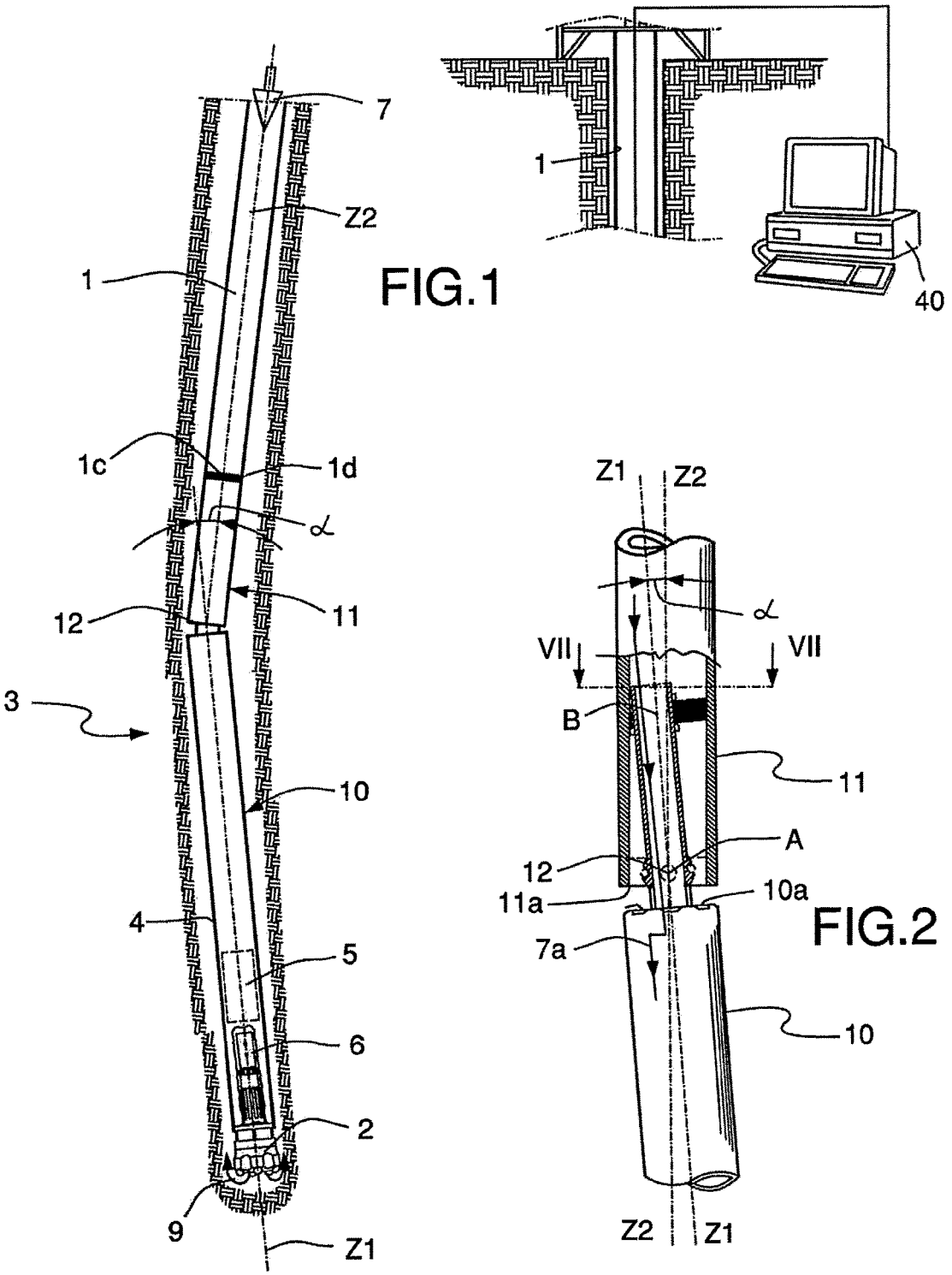
FIG. 1 shows a side view of an arrangement according to the invention to guide a drill string along a pathway during drilling with down-the-hole drilling equipment.
FIG. 2 shows a plan view, partially in section, of the arrangement according to the invention.

FIG. 1 shows a part of a drill string 1 that is united with a drilling rig located outside of the borehole and that is shown only schematically, with a drill tool or drill bit 2 at the front of the drill string in the borehole. The drill string 1 may comprise in known manner several elements or sections of drill rod connected sequentially together at their ends. A bottom hole assembly, abbreviated as "BHA" and generally denoted by 3, is located between the drill bit 2 and the said drill string 1 and is connected at its rear end to the drill string 1 through a connection piece 1*c* provided with a thread 1*d* (see also FIG. 3).

The bottom hole assembly 3 comprises a cylindrical machine housing 4 in which a bottom motor 5 that is activated by a pressurised medium and schematically illustrated with dash-dot contour is housed, which bottom motor drives as a unit an impact mechanism with a reciprocating piston 6 intended for alternate axial application of the drill bit 2 that is attached to the forward end of the bottom hole assembly 3 through a chuck. A working fluid 7 under pressure is led forwards to the bottom motor 5 of the bottom hole assembly 3 through a passage that extends centrally through the drill string 1. The flow of working fluid 7 through the central passage of the drill string 1 is illustrated, for the sake of simplicity, with only one flow arrow in FIG. 1. Rock material that has been removed is transported away from the working area in front of the drill bit 2 and backwards, up and out of the borehole that has been formed, with the aid of the working fluid that is supplied, as is illustrated by the curved arrows 9 indicated at the bottom of the borehole.

Figure 4:
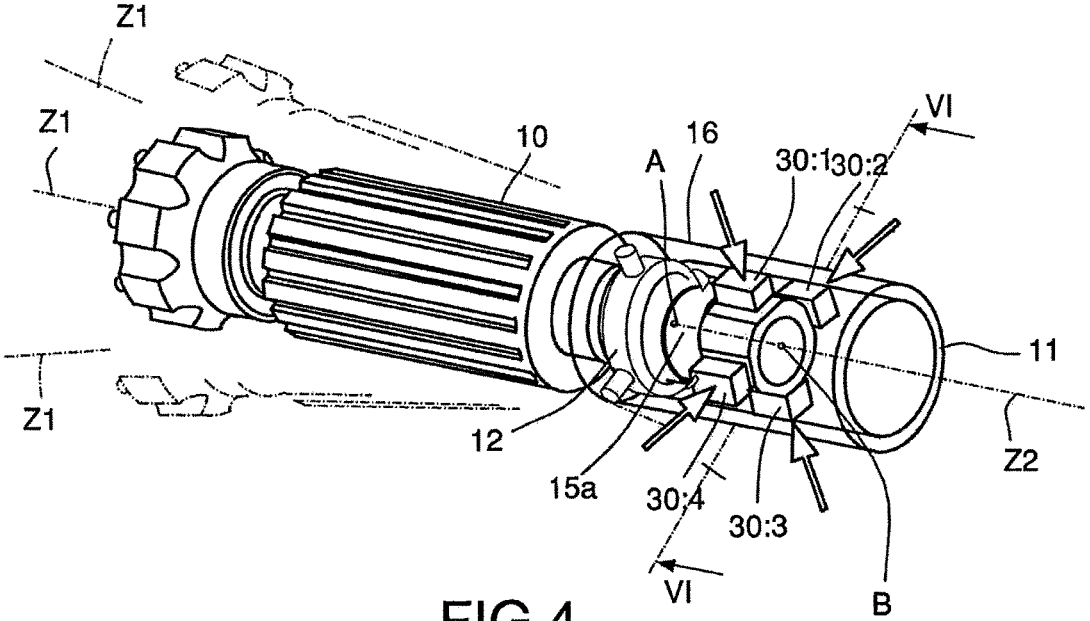
FIG. 4 shows a perspective X-ray view of the arrangement according to the invention.
Figure 6:
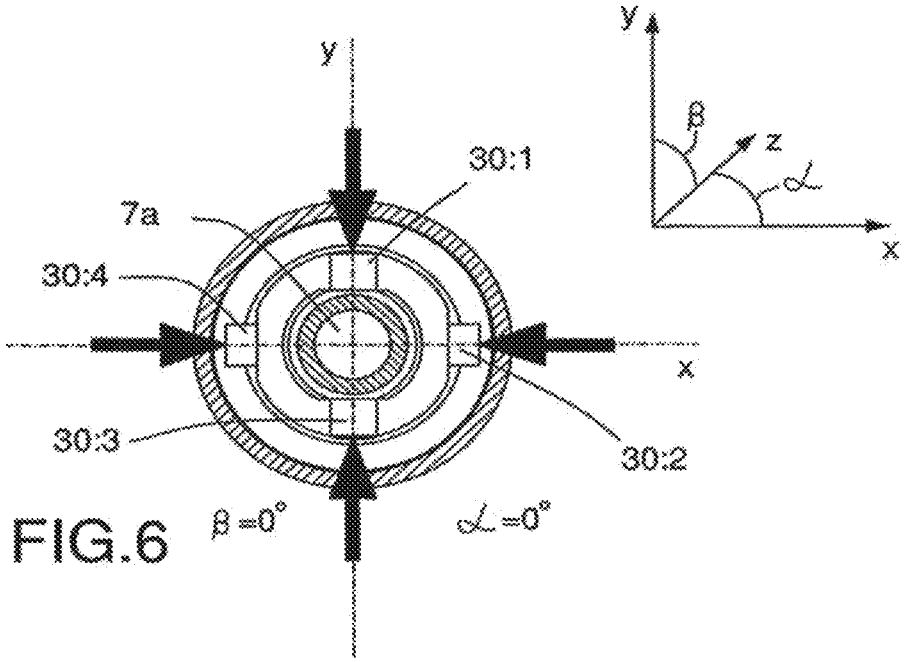
FIG. 6 shows a cross-section of a rotatory hinge joint that is a component of the arrangement according to the invention viewed along the line VI-VI in FIG. 4, and illustrating with arrows the forces that are applied for the setting of the arrangement, and thus also of a drill bit that is fixed attached at the front of the drill string, into different angles.
Figure 7A:
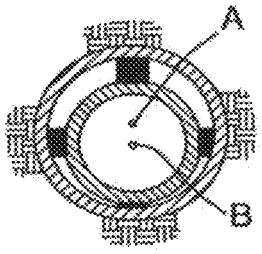
FIGS. 7*a*-7*d* show cross-sectional views through a borehole, viewed along the VII-VII in FIG. 2, that illustrate the guidance arrangement when set at different angular conditions.
Figure 7B:
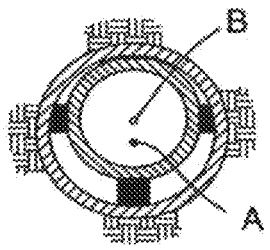
Figure 7C:
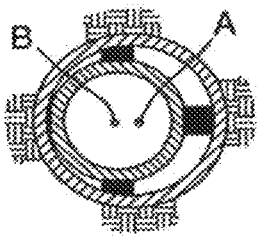
Figure 7D:
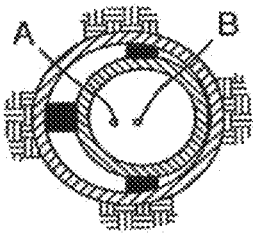

With reference to FIG. 2, there is shown in more detail a control arrangement for the direction guidance of the drill string according to the invention. This control arrangement is intended to form an integrated part of the bottom hole assembly 3. The control arrangement generally comprises a forward first tubular member 10 and a rear second tubular member 11, whereby the first tubular member 10 forms part of the said machine housing 4 described above, while the second tubular member 11 forms a guidance sheath that is active behind the machine housing intended to lie in line with the subsequent drill string 1. The two tubular members 10, 11 are connected in a cardan manner through a rotatory hinge joint 12 of universal type, by which they are joined in a manner that does not allow rotation. As a consequence of the universal joint, it is possible for the tubular members 10, 11 to transfer torque between themselves and to take up an angular condition $\alpha$ in the xz-plane and $\beta$ in the yz-plane, respectively, as is illustrated in FIGS. 4 and 6 through pivoting around a first axis x and a second axis y. It can be assumed in principle that the angle $\alpha$ relates to the angle in a horizontal plane xz-plane (yaw angle) and the angle $\beta$ relates to the angle in a vertical yz-plane (pitch angle). It should be understood that in practice it is the first tubular member 10 that is caused to take up an angular condition, a direction, relative to the condition of the second rear tubular member 11 (the guidance sheath) in the said angular condition $\alpha$, $\beta$ and the drill string 1, whereby the longitudinal axis z1 of the first tubular member 10 forms setting angles with the longitudinal axis z2 of the second tubular member 11 in the said plane. The longitudinal axes z1, z2 of the two tubular members 10, 11 coincide at one and the same point A at the centre of the rotatory hinge joint 12.

Figure 3:
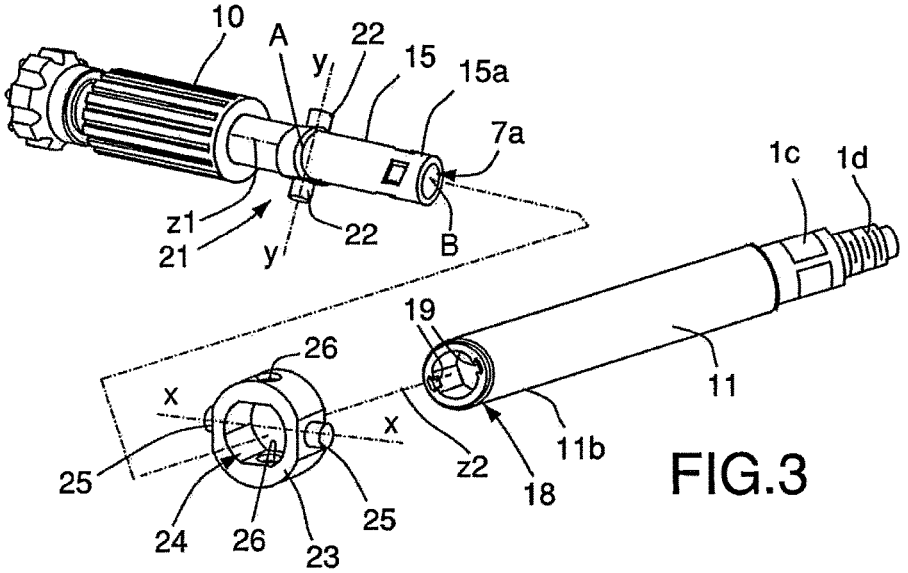
FIG. 3 shows a perspective view with separated parts of the arrangement according to the invention with a universal joint that is a component of the same, with an open central passage for a working fluid through the universal joint.

As is made most clear by FIGS. 2 and 3, the rotatory hinge joint 12 is a component of a tubular coupling shaft 15 that extends in a direction backwards from the rear end 10*a* of the first tubular member 10 that faces the rotatory hinge joint 12. It is appropriate that the tubular coupling shaft 15, the diameter of which is smaller than the diameter of the first tubular member 10, be designed as an integrated consecutive part of the gable end of the first tubular member or that it be fixed attached to the same by, for example, welding. The tubular coupling shaft 15 extends in an axial direction between the end parts 10*a*, 11*a* of the first and second tubular members 10, 11, which end parts oppose each other and face the rotatory hinge joint 12, and it is taken up into the internal cavity of the second member 11 in a manner that seals against the passage of fluid. Since the coupling shaft 15 is hollow, it is possible for a working fluid 7 to be transferred through the rotatory hinge joint 12 from the drill string 1 to the bottom motor 5 in the first tubular member 10. Working fluid 7 can be transferred through the central passage that is formed through the internal cavity of the coupling shaft 15, whereby a flow of working fluid that is led through the passage of the coupling shaft 15 is illustrated by the flow arrow 7*a* in FIG. 2.

Figure 5:
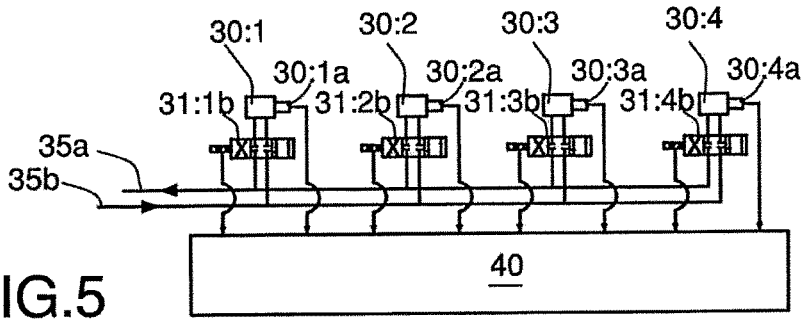
FIG. 5 shows a block diagram of a control system that is a component of the arrangement for the monitoring and guidance of the angular conditions of the arrangement.

As is made clear by FIGS. 4 and 5, the coupling shaft 15 unites the first and second tubular members 10, 11 at opposing ends in such a manner that the two tubular members can pivot around a first x and a second y geometric axis, respectively, each one of which is perpendicular to the longitudinal axis z1 of the coupling shaft, which longitudinal axis is coincident with the central axis of the first tubular member 10. In order to make this pivoting motion possible, the coupling shaft 15 is provided with pegs 12 that are mounted on the peripheral outer surface of the coupling shaft 15. The said pegs 12 unite the end sections 10*a*, 11*a* of the tubular members 10, 11, which end sections meet and are taken up one inside the other, one end section 10*a* of which is taken up into the second end section 11*a* (see FIG. 2) such that the two tubular members, with respect to their respective longitudinal axes z1, z2, can take up different angular conditions, i.e. the angle $\alpha$ in the xz-plane and the angle $\beta$ in the yz-plane, respectively, through being pivoted in a cardan manner.

As has been mentioned above, the tubular coupling shaft 15 that extends backwards forms an extension of the first tubular member 10 that stretches backwards and that includes at the same time the bottom motor 5 in order to drive the impact mechanism and hammer of the bottom hole assembly. The tubular coupling shaft 15 can be said to form what is known as a "hammer extension", i.e. a form of lever that extends through the centre of the rotatory hinge joint 12. The coupling shaft 15 has been given such a length with respect to the location of the rotatory hinge joint 12 at the coupling shaft that an end section 15*a* of the rear end of the coupling shaft is, when in an initial condition, concentrically taken up a certain distance into the internal cavity of the second tubular member 11. According to the invention, this end section 15*a* of the coupling shaft 15 has the task not only of functioning as the said lever inside the second tubular member 11, but also of forming a central passage 7*a* for the transfer of working fluid between the tubular members 10, 11 and onwards to the bottom motor 5.

With reference to FIG. 3, the rotatory hinge joint 12 is there shown in more detail. The rotatory hinge joint 12 is designed as a universal joint that can be divided with pegs and holes that fit into each other, possibly also with intermediate needle roller bearings at which opposing surfaces of the said pegs and holes act as bearing tracks. What is characteristic for the universal joint is that it allows an open central passage 7*a* through the coupling shaft 15 such that the internal cavities in the two tubular members 10, 11 can communicate with each other, and that working fluid is led in this manner from the drill string 1 to the bottom motor 5 of the first tubular member 10, whereby the working fluid passes centrally through the rotatory hinge joint 12.

The rotatory hinge joint 12 includes pegs that demonstrate a driving part 18 that is designed as a fork joint with opposing holes 19 in a part of the forward end 11*a* of the second tubular member 11, a driven part 21 designed as a ring-shaped yoke with two axle pegs 22 that are diametrically oriented radially protruding from the yoke, which yoke is mounted at the coupling shaft 15 surrounding the circumference of the same, and an intermediate cardan ring 23 that demonstrates a central opening 24 with two axle pegs 25 that are diametrically oriented and protrude from the ring, with two diametrically opposing holes 26 in the ring. The diametrically opposing axle pegs and holes of the cardan ring 23 lie in a common plane that is perpendicular to the longitudinal axis z1 of the coupling shaft 15 and the said axle pegs and holes are equally distributed, while being mutually displaced around the circumference by 90°. In the assembled condition, all parts 18, 21, 23 that are components of the rotatory hinge joint 12 are integrated in and surrounded in a ring-shaped compartment that is limited by the end 11*a* of the second tubular member 11 and the end section 15*a* of the coupling shaft 15.

The present invention is illustrated in FIG. 6 in an initial condition with the aid of a coordinate system whereby the x- and y-coordinate axes that are specified are assumed to be perpendicular to the central axes z1, z2 of the tubular members 10, 11, respectively, which can be assumed to extend into the plane of the paper in the drawing. In this initial condition, when each one of the angles α formed in the xz-plane and β formed in the yz-plane between the tubular members 10, 11 has a value of zero (α=0; β=0), the drill string 1, together with the bottom hole assembly 3 formed by the tubular members 10, 11, moves essentially in a straight line.

As is made most clear by FIGS. 4 and 5, the present arrangement comprises a series of control and actuator means 30:1-30:4 that are radially active in the ring-shaped compartment that is limited between the rear end section 15*a* of the coupling shaft 15 and the inner surface or cavity wall of the second tubular member 11. It is appropriate that the control and actuator means 30:1-30:4 be hydraulically active piston and cylinder devices, and they are distributed with equal mutual separation around the circumference of the coupling shaft 15. The first tubular member 10 and thus also the drill bit 2 can, with the aid of the control and actuator means 30:1-30:4, be set obliquely into any freely chosen angular condition in the compartment relative to the second tubular member 11 (the guiding sheath), and thus also the drill string. The control and actuator means 30:1-30:4 can be set selectively and independently of each other into a radially extended or radially withdrawn condition, and are each provided with a length sensor 31:1*a*-31:4*a*. The control and actuator means 30:1-30:4 can be driven in any appropriate manner, but it is an advantage if it is driven through the use of a partial flow (not shown in the drawings) of the driving means 35 in the form of working fluid 7 that is used for to drive the impact mechanism of the drill bit 2 that is a component of the bottom hole assembly. Driving means in the form of an input flow such as a partial flow of the working fluid of the bottom hole assembly is denoted by 35*a* in FIG. 5. The return flow of the driving means is denoted by 35*b*.

A drive system to use a partial flow of the said working fluid may comprise a hydraulic system, in which flow valves 31:1*b*-31:4*b* are components and by means of which the control and actuator means 30:1-30:4 of the arrangement can be selectively set, i.e. set into conditions in which they are mutually radially extended or withdrawn. The angle α in the xz-plane; β in the yz-plane between the first and second tubular members 10, 11 can be changed with the aid of the flow valves 31:1*b*-31:4*b* between zero and a maximum value, for example, between α=0°; β=0° and a freely chosen angle α and β.

An operator located at a distance from the control arrangement can guide and monitor the drilling operation with the aid of a computer equipped with a display. It is appropriate that guidance and monitoring signals be transferred between the control and actuator means 30:1-30:4. The control and actuator means can be set with the aid of flow valves 31:1*b*-31:4*b* into a radially extended or a radially withdrawn condition relative to each other. The control signals between the said computer that is located at a distance and the control and actuator means can take place by means of a line that stretches along the drill string 1, or in a wireless manner over a radio link (not shown in the drawings). It is appropriate that the control and actuator means 30:1-30:4 be of the type that is equipped with electronic position sensors 30*a*:1-30*a*:4, for example of inductive type, that detect the value of the extension of the cylinder in the relevant piston-cylinder arrangement, which can be used for the calculation of the angular conditions α and β between the forward first tubular member 10 and the second tubular member 11. Information about the mutual angular condition between the two tubular members 10, 11, α and β in the said planes, xz and yz, respectively, makes it possible to guide and monitor at a distance the direction of motion of the drill bit 2 in space. The rear end section 15*a* of the coupling shaft 15 is used as a lever under the influence of the said radially acting control and actuator means 30:1-30:4. A remote control unit 40 that may include the said computer transmits and receives in the form of electronic signals not only information from the operator, but also information about, extra "receive"] the position sensors 30*a*:1-30*a*:4 of the relevant control and actuator means 30:1-30:4. The angular condition of the control arrangement in the angle α in the xz-plane; β in the yz-plane can be determined by using an appropriate three-dimensional mathematical calculation system that makes it possible to calculate the mutual angles of the first and second tubular members 10, 11 in the said relevant planes. Since the distance between the measuring points that are defined by the centre of the rotatory hinge joint 12 denoted A in FIG. 4 and the central point at which the radially directed control and actuator means 30:1-30:4 intersect each other in a plane through the rear part 15*a* of the coupling shaft 15 at a second central point B is constant and can be said to form in principal a vector with a defined length, a Cartesian coordinate system could advantageously be used to calculate the mutual angular condition α and β of the first and second tubular members 10, 11, i.e. how the first tubular member 10 moves in the sideways direction and how it moves in the vertical direction relative to the second tubular member 11 or guide sheath.

FIGS. 7*a*-7*d* illustrate how it is possible, by selectively changing radially active lengths of the control and actuator means 30:1-30:4, to set the angles α in the xz-plane; β in the yz-plane between the central axes Z1, Z2 of the two tubular members 10, 11 into any free angular condition in space using the rotatory hinge joint 12.

The invention is not limited to what has been described above and shown in the drawings: it can be changed and modified in several different ways within the scope of the innovative concept defined by the attached patent claims.

The invention claimed is:

1. An arrangement for the angular setting of a drill string in a borehole, comprising:

a first tubular member provided with a bottom motor that, driving a drill bit, is supplied with a working fluid that is led through the drill string, a second tubular member that is attached at one end of the drill string, whereby the two tubular member are joined to each other by a rotatory hinge joint in such a manner that torque can be transferred between the two tubular members and that the tubular members can be adjusted in their mutual angular condition through pivoting around a shaft, wherein the longitudinal axis of the first tubular member forms a setting angle with the longitudinal axis of the second tubular member, wherein the longitudinal axes of the two tubular members coincide in one and the same point in the rotatory hinge joint, wherein the first and second tubular members include end sections, one of which is taken up into the other in the rotatory hinge joint, and are connected by means of pegs for pivoting around a first and a second geometric axis, respectively, that intersect with each other in a first central point of the longitudinal axes of the united tubular members, a plurality of control and actuator devices that can be shortened and lengthened in a longitudinal direction through the influence of a driving device, wherein the control and actuator devices are evenly distributed around the circumference of a ring-shaped compartment that is limited between the end sections that are taken up one inside the other, and the control and actuator devices are arranged to act in radial directions where they intersect with each other in a second central point of the longitudinal axes of the two united tubular members, remote controllers by which the control and actuator devices can be set selectively and independently of each other in a radially extended or radially withdrawn condition, whereby the relevant central axes of the tubular members can be caused to take up a predetermined angular condition in a first setting angle in an xz-plane and a second setting angle in a yz-plane around the first central point through selective change of the radially active lengths of the control and actuator devices in the second central point.

2. The arrangement of claim 1, whereby the end section of the first tubular member is surrounded by the end section of the second tubular member in a longitudinal direction that extends from the first central intersection point for the peg to the second central intersection point for the control and actuator devices.

3. The arrangement of claim 1, whereby the end section of one tubular member includes a tubular coupling shaft designed as an axially directed extension of the tubular member, and the second tubular member includes an end section that is provided with an opening into which the internal cavity of the tubular member opens out, in which the end section of the tubular coupling shaft is taken up into the said internal cavity through the opening.

4. The arrangement of claim 3, whereby the end section of the coupling shaft is used as a lever with a joint in the first central intersection point under the influence of the radially acting control and actuator devices.

5. The arrangement of claim 3, whereby the peg comprises a driving part that is designed as a fork joint with opposing holes in one part the end section of the second tubular member, a driven part designed as a ring-shaped yoke with two protruding axle pegs diametrically oriented radially outwards from the yoke, which yoke is mounted at the outer surface or circumference of the coupling shaft, and an intermediate cardan ring that includes a central opening with two axle pegs that protrude diametrically oriented from the cardan ring and two diametrically opposing holes in the cardan ring.

6. The arrangement of claim 3, whereby component parts of the peg are all located, in a connected condition of the tubular members, integrated into and surrounded by a ring-shaped compartment that is limited by the end section of the second tubular member and the end section of the coupling shaft.

7. The arrangement of claim 1, whereby each control and actuator device is provided with a length sensor and can be set selectively and independently of the others in a radially extended or withdrawn condition relative to the longitudinal axes of the tubular members through the influence of flow valves that are component parts of the remote controller.

8. The arrangement of claim 7, whereby the remote controller allows control and monitoring signals to be transferred between the length sensors of the control and actuator devices and a computer, whereby, based on the measured values from the length sensors a first setting angle in an xz-plane and a second setting angle in a yz-plane between the longitudinal axes of the tubular members is calculated with the aid of the computer, where each one of the said setting angles is measured based on the relative angular condition around the first central point.

9. A down-the-hole drilling equipment comprising:

a first tubular member provided with a bottom motor and drill bit fastened into a chuck, a second tubular member, a rotatory hinge joint that is located between the tubular members and allows torque to be transferred and allows the tubular members to be set into angular conditions through pivoting around an axis, wherein the longitudinal axis of the first tubular member forms a setting angle with the longitudinal axis of the second tubular member and the two longitudinal axes of the two tubular members coincide in one and the same point in a jointed connector, wherein the first tubular member includes an end section provided with a tubular coupling shaft designed as an axially directed extension of the tubular member, wherein the second tubular member include an end section provided with an opening through which a part of the coupling shaft is taken up and extends a certain distance into the internal cavity of the second tubular member, a peg for pivoting around first and second geometric axes, respectively, that intersect in a first central point of the longitudinal axes of the two tubular members that are taken up into each other, a plurality of control and actuator devices that can be shortened and extended by the influence of a driving device and wherein the control and actuator devices are evenly distributed around the circumference of a ring-shaped compartment that is limited between the end sections of the tubular members that are taken up one inside the other, and wherein the control and actuator devices are arranged to act in radial directions where they intersect with each other in a second central point of the longitudinal axes of the two united tubular members, whereby the relevant central axes of the tubular members can be caused to take up a predetermined angular condition in a first setting angle in an xz-plane and a second setting angle in a yz-plane around the first central point through selective change of the radially active lengths of the control and actuator devices in the second central point.

* * * * *